US009857132B2

(12) United States Patent
Ballard

(10) Patent No.: US 9,857,132 B2
(45) Date of Patent: Jan. 2, 2018

(54) RIFLE STOCK

(71) Applicant: Pro Mag Mfg. Inc., Phoenix, AZ (US)

(72) Inventor: Michael W. Ballard, Surprise, AZ (US)

(73) Assignee: PRO MAG MFG., INC., Phoenix, AZ (US)

( * ) Notice: Subject to any disclaimer, the term of this patent is extended or adjusted under 35 U.S.C. 154(b) by 95 days.

(21) Appl. No.: 14/149,795

(22) Filed: Jan. 7, 2014

(65) Prior Publication Data

US 2015/0192384 A1 Jul. 9, 2015

(51) Int. Cl.
*F41A 9/70* (2006.01)

(52) U.S. Cl.
CPC ..... *F41A 9/70* (2013.01)

(58) Field of Classification Search
CPC .... F41A 9/66; F41A 17/34; F41A 9/70; F41A 3/66; F41A 3/84; F41A 35/00; F41C 7/00; F41C 33/007; F42B 39/02; G09F 23/00; H02J 5/005
USPC ..... 42/71.01
See application file for complete search history.

(56) References Cited

U.S. PATENT DOCUMENTS 663,955 A * 12/1900 Burgess ..... F41A 3/16 42/11
663,956 A 12/1900 Burgess
715,971 A 12/1902 Burgess
2,053,489 A 9/1936 Norman
2,557,144 A * 6/1951 Schaich ..... F41A 5/16 42/50
2,701,504 A * 2/1955 Schaich ..... F41A 9/47 42/50
3,572,310 A * 3/1971 Chiba ..... F41A 9/62 124/31
4,384,508 A * 5/1983 Sullivan et al. ..... 89/33.02
4,765,224 A * 8/1988 Morris ..... 89/191.01
4,970,818 A * 11/1990 Vecchieschi ..... F41A 9/70 42/50
5,168,648 A * 12/1992 Brandl ..... F41A 9/70 42/50
5,502,913 A * 4/1996 Jackson ..... F41A 9/66 42/50
5,561,258 A * 10/1996 Bentley et al. ..... 89/33.17
5,711,286 A * 1/1998 Petrosyan et al. ..... 124/73
(Continued)

*Primary Examiner* — Michelle R Clement
*Assistant Examiner* — Bridget Cochran
(74) *Attorney, Agent, or Firm* — Bennet K. Langlotz; Langlotz Patent & Trademark Works, Inc.

(57) ABSTRACT

A rifle stock has a body defining a magazine well configured to closely and removably receive at least a portion of the magazine, the body including an actuation element proximate the magazine well, the magazine well being a passage defining an insertion axis, and the actuation element having an actuation surface portion angularly offset from the insertion axis, such that the cartridge retention element operably encounters and is moved by the actuation element upon insertion of the magazine. There may be a magazine having a body with an exterior profile sized to be closely and removably received in the magazine well, the body defining a central passage configured to receive a plurality of ammunition cartridges, the passage having an open upper end, a cartridge retention element attached to the body and movable between a first retention position, and a second released position.

18 Claims, 11 Drawing Sheets

(56) References Cited

U.S. PATENT DOCUMENTS

| | | | | |
|---|---|---|---|---|
| 5,771,620 | A * | 6/1998 | Crawford et al. | 42/19 |
| 5,771,875 | A * | 6/1998 | Sullivan | 124/72 |
| 6,470,872 | B1 * | 10/2002 | Tiberius et al. | 124/74 |
| 6,502,495 | B1 * | 1/2003 | Beary | 89/34 |
| 8,156,675 | B2 * | 4/2012 | Heath | F41A 9/65 42/17 |
| 8,468,929 | B2 * | 6/2013 | Larson et al. | 89/193 |
| 8,863,422 | B2 * | 10/2014 | Ballard | F41A 9/70 42/49.01 |

* cited by examiner

RIFLE STOCK

FIELD OF THE INVENTION

The present invention relates to firearms, and more particularly to a rifle stock that modernizes a Mosin-Nagant bolt action rifle by enabling usage of a detachable magazine.

BACKGROUND OF THE INVENTION

The Mosin-Nagant is a bolt-action, internal magazine-fed, military rifle originally developed by the Imperial Russian Army in the late 1800's. As various countries' militaries have modernized and decommissioned the rifle, a large quantity of Mosin-Nagants have found their way onto civilian markets as collectibles and hunting rifles There is serious collector interest in the Mosin-Nagant family of rifles, and they are popular with target shooters and hunters because of their durability, reliability, and accuracy when fitted with a scope.

Although these characteristics provide obvious advantages to the user, unmodified military surplus Mosin-Nagant rifles suffer from significant disadvantages compared to modern rifles with detachable magazines. Instead, the Mosin-Nagant uses an integral, single stack magazine with a five round capacity loaded from a clip charger. As a result, a standard Mosin-Nagant rifle does not provide the capability of rapid reloads and the associated tactical benefits associated with detachable magazines.

Therefore, a need exists for a new and improved rifle stock that modernizes a Mosin-Nagant bolt action rifle by enabling usage of a detachable magazine. In this regard, the various embodiments of the present invention substantially fulfill at least some of these needs. In this respect, the rifle stock according to the present invention substantially departs from the conventional concepts and designs of the prior art, and in doing so provides an apparatus primarily developed for the purpose of modernizing a Mosin-Nagant bolt action rifle by enabling usage of a detachable magazine.

SUMMARY OF THE INVENTION

The present invention provides an improved rifle stock, and overcomes the above-mentioned disadvantages and drawbacks of the prior art. As such, the general purpose of the present invention, which will be described subsequently in greater detail, is to provide an improved rifle stock that has all the advantages of the prior art mentioned above.

To attain this, the preferred embodiment of the present invention essentially comprises a body defining a magazine well configured to closely and removably receive at least a portion of the magazine, the body including an actuation element proximate the magazine well, the magazine well being a passage defining an insertion axis, and the actuation element having an actuation surface portion angularly offset from the insertion axis, such that the cartridge retention element operably encounters and is moved by the actuation element upon insertion of the magazine. There may be a magazine having a body with an exterior profile sized to be closely and removably received in the magazine well, the body defining a central passage configured to receive a plurality of ammunition cartridges, the passage having an open upper end, and a cartridge retention element attached to the body and movable between a first retention position, and a second released position, the cartridge retention element having a retention portion that is positioned above at least a portion of the open upper end of the passage when the cartridge retention element is in the first retention position, and positioned laterally clear of the open upper end of the passage when the cartridge retention element is in the second released position, such that cartridges in the magazine passage are prevented from escaping when the cartridge retention element is in the first position, and permitted to escape when the cartridge retention element is in the second position. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
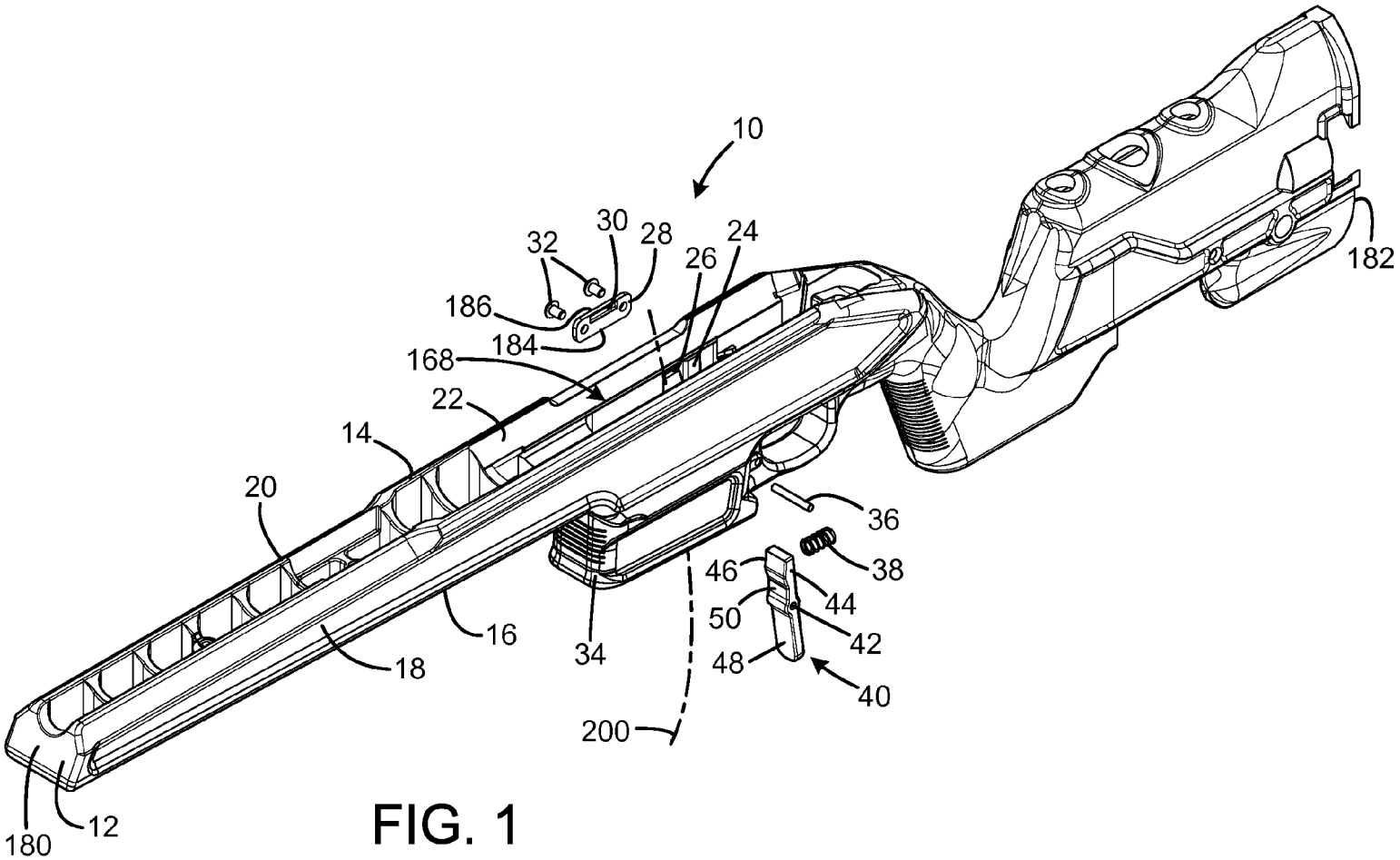
FIG. 1 is a top front isometric exploded view of the current embodiment of the rifle stock constructed in accordance with the principles of the present invention.

An embodiment of the rifle stock of the present invention is shown and generally designated by the reference numeral 10.

Figure 10:
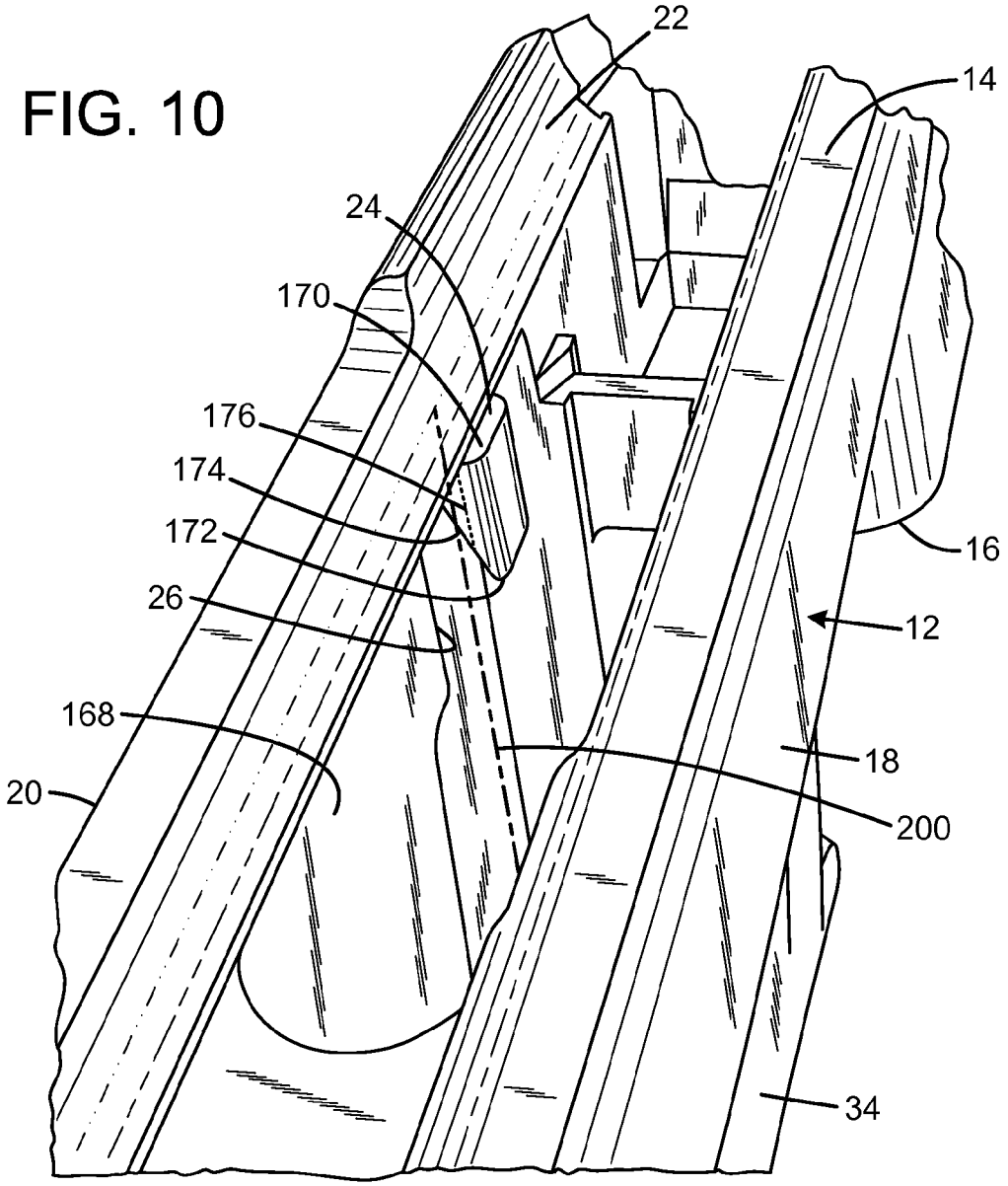
FIG. 10 is a top front isometric fragmentary view of the rifle stock of FIG. 1.
Figure 11:
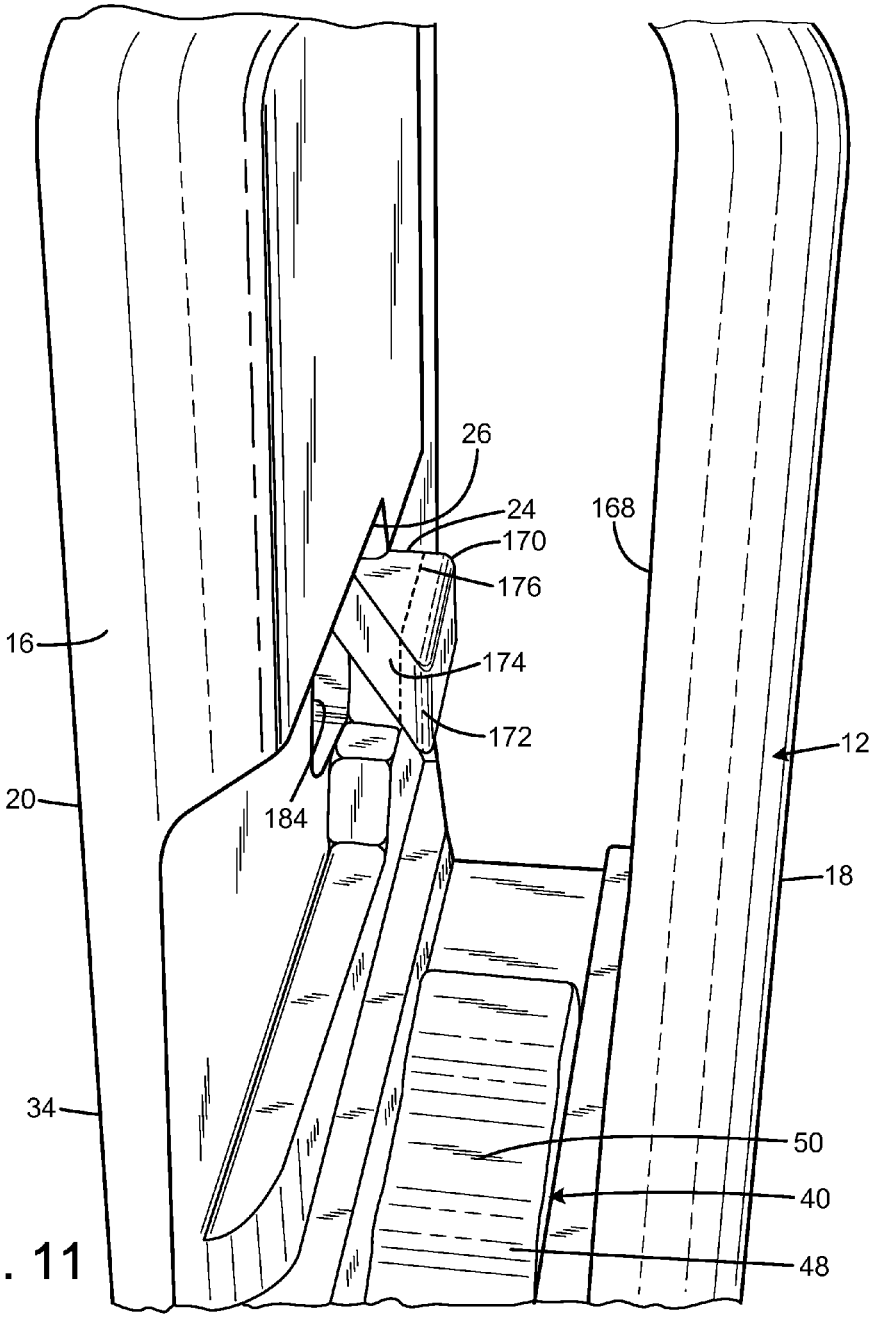
FIG. 11 is a bottom front isometric fragmentary view of the rifle stock of FIG. 1.

FIGS. 1, 10, and 11 illustrate the improved rifle stock 10 of the present invention. More particularly, the rifle stock has a body 12 having a top 14, a bottom 16, a front 180, a rear 182, a left side 18, and a right side 20. The top of the body defines a receiver groove (or receiver receptacle channel) 22 that receives a receiver and barrel when the rifle stock is assembled into a rifle. A cover plate 28 is removably secured to the right side of the body by cover plate screws 32. The cover plate has an exterior surface 184 that abuts the right side of the rifle stock when the cover plate is attached thereto. The top 186 of the cover plate defines a recess 30. In the current embodiment, the cover plate is made of metal.

The bottom 16 of the body 12 includes a magazine well 34, which is downwardly protruding in the current embodiment. The magazine well defines a central bore 168 that communicates with the receiver groove 22. The central bore defines an insertion axis 200. The insertion axis can be curved since it represents the path of insertion of the magazine 52. The magazine body 54 is curved and tubular in the current embodiment. A magazine catch 40 is pivotally mounted on a dowel pin 36 within the central bore. The dowel pin is received within a bore 42 that extends from the left side 44 to the right side 46 of the magazine catch. The front 48 of the magazine catch defines a recess 50 above the bore. A magazine catch spring 38 is mounted behind the magazine catch above the bore to bias the magazine catch forward. The forward bias urges the portion of the front of the magazine catch located above the bore to protrude into the central bore. In the current embodiment, the dowel pin is ⅛"×⅞", and the body and magazine catch are made of molded plastic.

Figure 2:
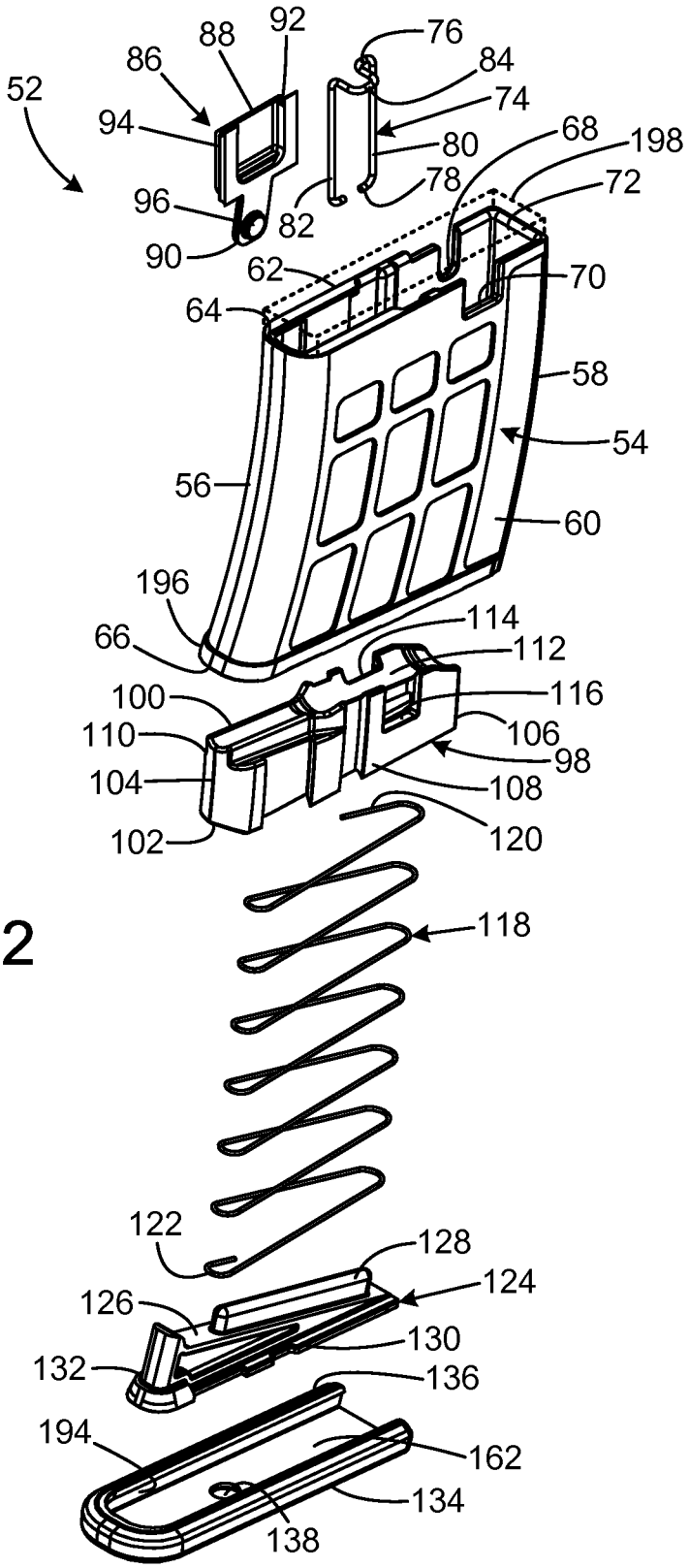
FIG. 2 is a front exploded view of the current embodiment of the magazine constructed in accordance with the principles of the present invention.
Figure 3:
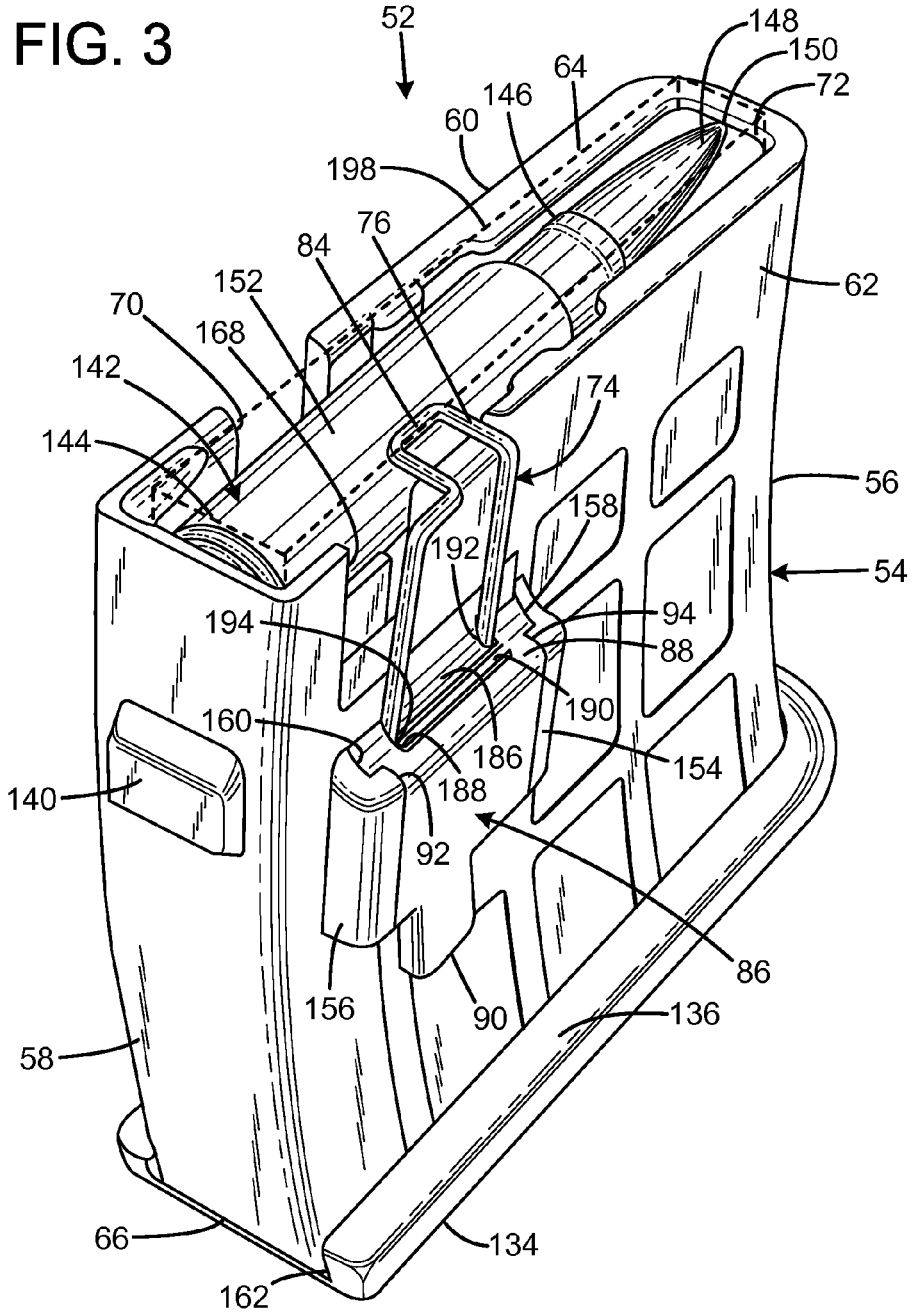
FIG. 3 is a top rear isometric view of the current embodiment of the magazine of FIG. 2 loaded with a single cartridge.
Figure 4:
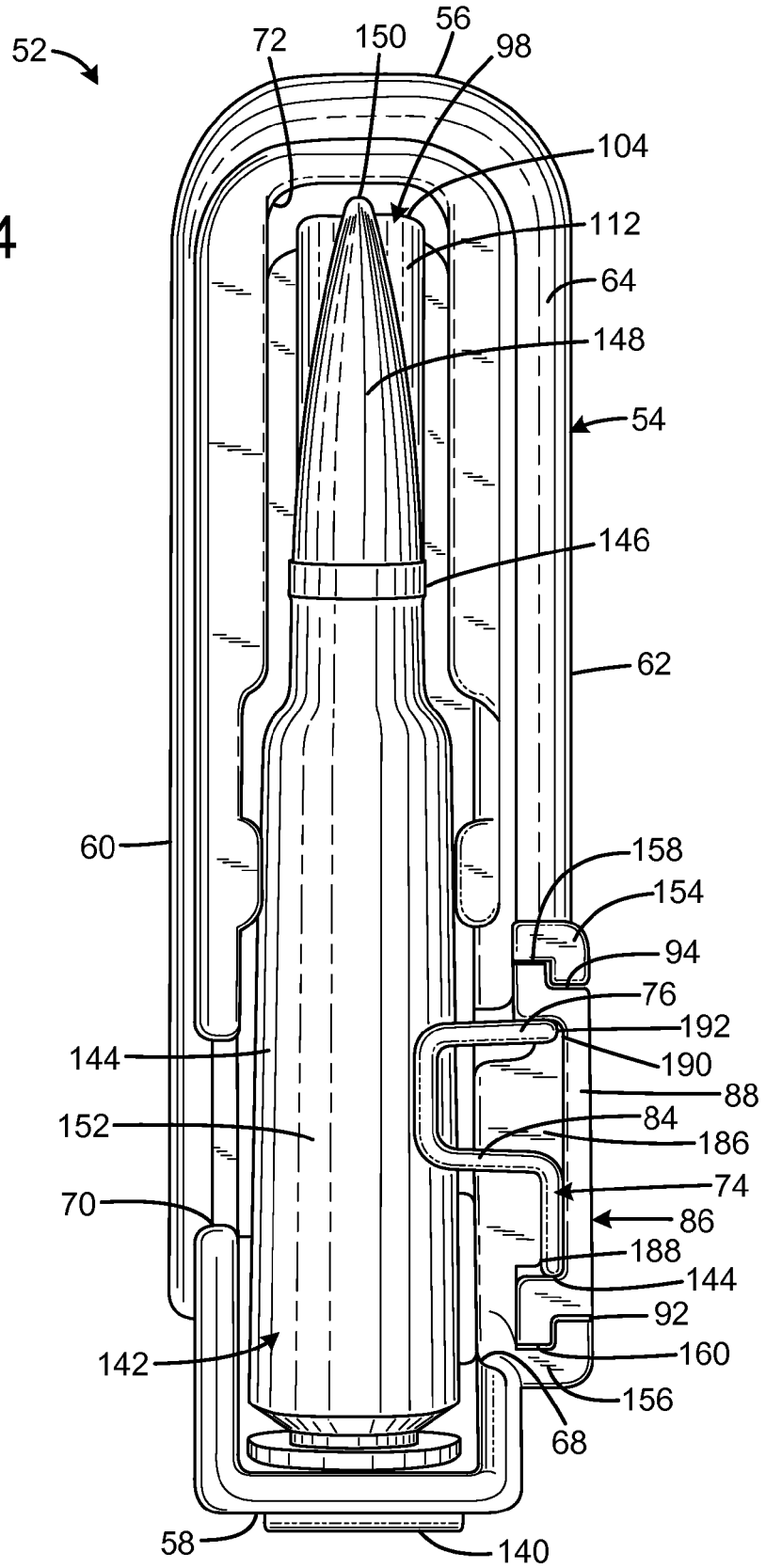
FIG. 4 is a top view of the current embodiment of the magazine of FIG. 2 loaded with a single cartridge.

FIG. 2-4 illustrate the improved magazine 52 of the present invention uninstalled from the rifle stock 10. More particularly, the magazine has a tubular magazine body 54 that defines a central bore 72 and is generally rectangular in cross-section. The magazine body has a front 56, rear 58, left side 60, right side 62, top 64, and bottom 66. The top rear of the magazine body defines a shell separator clearance notch 70 on the left side and a cartridge catch clearance notch 68 on the right side. The shell separator is integral to the firearm and is not shown. The bottom of the magazine body includes an outwardly protruding flange 196 along the perimeter.

The right side 62 of the magazine body 54 (shown in FIG. 3) includes opposed, spaced apart, and outwardly protruding front and rear supports 154, 156 and a central support 186. The front and rear supports each define an opposed slot (front support slot 158 and rear support slot 160). The central support defines grooves 192, 194 on its opposing sides 188, 190. The right side of the magazine body also defines an aperture (not visible) positioned below and centered between the front and rear supports.

The rear 58 of the magazine body 54 (shown in FIG. 3) includes a rearwardly protruding ledge 140. When the magazine 54 is fully inserted into the central bore 168 of the magazine well 34, the ledge is received by the recess 50 on the front 48 of the magazine catch 40. The magazine catch prevents the magazine from falling out of the bottom of the central bore unless the user deliberately pivots the magazine catch to disengage the recess from the ledge, which enables the magazine to be pulled out of the magazine well.

A cartridge catch retainer 86 is used to attach a cartridge catch (or movable cartridge retention element) 74 to the right side 62 of the magazine body 54. The cartridge catch retainer has a top 88, bottom 90, and defines opposed front and rear slots 94, 92 on its sides. The bottom of the cartridge catch retainer includes a nipple 96 that protrudes outwardly. The cartridge catch is a movable resilient element having a top 76 and a bottom 78. The bottom of the cartridge catch includes a forward arm 82 and a rear arm 80. The top of the cartridge catch includes a U-bend (retention) portion 84. In the current embodiment, the cartridge catch retainer is made of molded plastic and the cartridge catch is an elongate metal wire that is articulated or bent to create the desired features.

A follower 98, magazine spring 118, and lock plate 124 are received within the central bore 72 of the magazine body 54. The follower has a top 100, bottom 102, front 104, rear 106, left side 108, and right side 110. The top of the follower defines a cartridge groove 112. The top right of the follower defines a cartridge catch clearance notch 114. The top left side of the follower defines a shell separator clearance notch 116. The bottom of the follower receives the top 120 of the magazine spring. The magazine spring urges the follower upward within the magazine body, but the top 64 of the magazine body is shaped to limit the upward movement of the follower to prevent the follower from being pushed out of the magazine body. The magazine spring is a rectangular coil spring in the current embodiment.

The lock plate 124 has a left side 130, a right side 132, and a top 126. The top of the lock plate defines an upwardly protruding spring support 128. The spring support receives the bottom 122 of the magazine spring 118. The spring support prevents the magazine spring from developing coil lock when the magazine spring is fully compressed by the follower when the magazine 52 is fully loaded with cartridges 142. The left and right sides of the lock plate are shaped to be closely received within the central bore 72 at the bottom 66 of the magazine body 54.

The magazine 54 also includes a base plate 134 having a top 136 that defines a groove 194, a recess 162, and an aperture 138. The groove 194 is sized to closely receive the flange 192 on the bottom 66 of the magazine body 54. The base plate is slid onto the bottom of the magazine body from the front 56. A screw (not shown) is then inserted through the aperture 138 and threaded into a threaded aperture (not visible) in the bottom of the lock plate 124 to releasably secure the base plate to the bottom of the magazine body. The base plate prevents the lock plate, magazine spring 118, follower 98, and any loaded cartridges 142 from falling out of the bottom 66 of the magazine body.

FIGS. 3 & 4 illustrate the improved magazine 52 of the present invention. More particularly, a single cartridge 142 is shown loaded into the central bore 72 of the magazine body 54. The cartridge has a casing 144 with a front 146 and an exterior surface 152. A bullet 148 with a nose 150 extends from the front of the casing. The cartridge is received within the cartridge groove 112 on the top 100 of the follower 98. The magazine spring 118 urges the follower and cartridge upwards within the central bore of the magazine body.

A conventional detachable magazine has feed lips that hold the uppermost cartridge in the magazine, preventing it from being ejected upward by the magazine spring. The uppermost cartridge 142 is then stripped out forwardly to load the firearm. If used with a Mosin-Nagant rifle, however, feed lips would prevent the cartridges from being fed because the cartridges feed upwardly, not forwardly. Therefore, feed lips cannot be used, and the cartridge catch 74 of the present invention is required to retain the uppermost cartridge within the magazine 52. A column of space 198 above the interior of the magazine defines a zone into which the cartridge catch must intrude in a first position to retain the uppermost cartridge and must be withdrawn in a second position to release the uppermost cartridge. The U-bend portion 84 of the cartridge catch extends inwards above the top 64 of the magazine body 54. The U-bend portion engages the exterior surface of the casing, thereby limiting upward movement of the cartridge and preventing the cartridge from inadvertently falling out of the top of the magazine body.

The cartridge catch 74 is secured to the right side 62 of the magazine body 54 by first inserting the front and rear arms 80, 82 into the grooves 192, 194 on either side of the central support 186. The bottom 78 of each arm is bent towards the other and fits underneath the central support to limit upward movement of the cartridge catch. Subsequently, the front and rear slots 94, 92 of the cartridge catch retainer 86 are engaged with the front and rear support slots 158, 160 of the front and rear supports 154, 156 and the nipple 96 is inserted into the aperture in the right side of the magazine body. The top 88 of the cartridge catch retainer provides a pivot point for the cartridge catch to flex outwardly away from the magazine body, but prevents the cartridge catch from detaching from the magazine body. The cartridge catch retainer secures the arms to the magazine and secures them from movement while providing enough support and strength to keep the cartridge catch retainer and the magazine from fracturing as the top of the catch retainer flexes. The top of the catch retainer is a resilient cantilever that is biased to the first position to retain the uppermost cartridge and is the only portion of the magazine overhanging the open top 64 of the magazine body.

Figure 5:
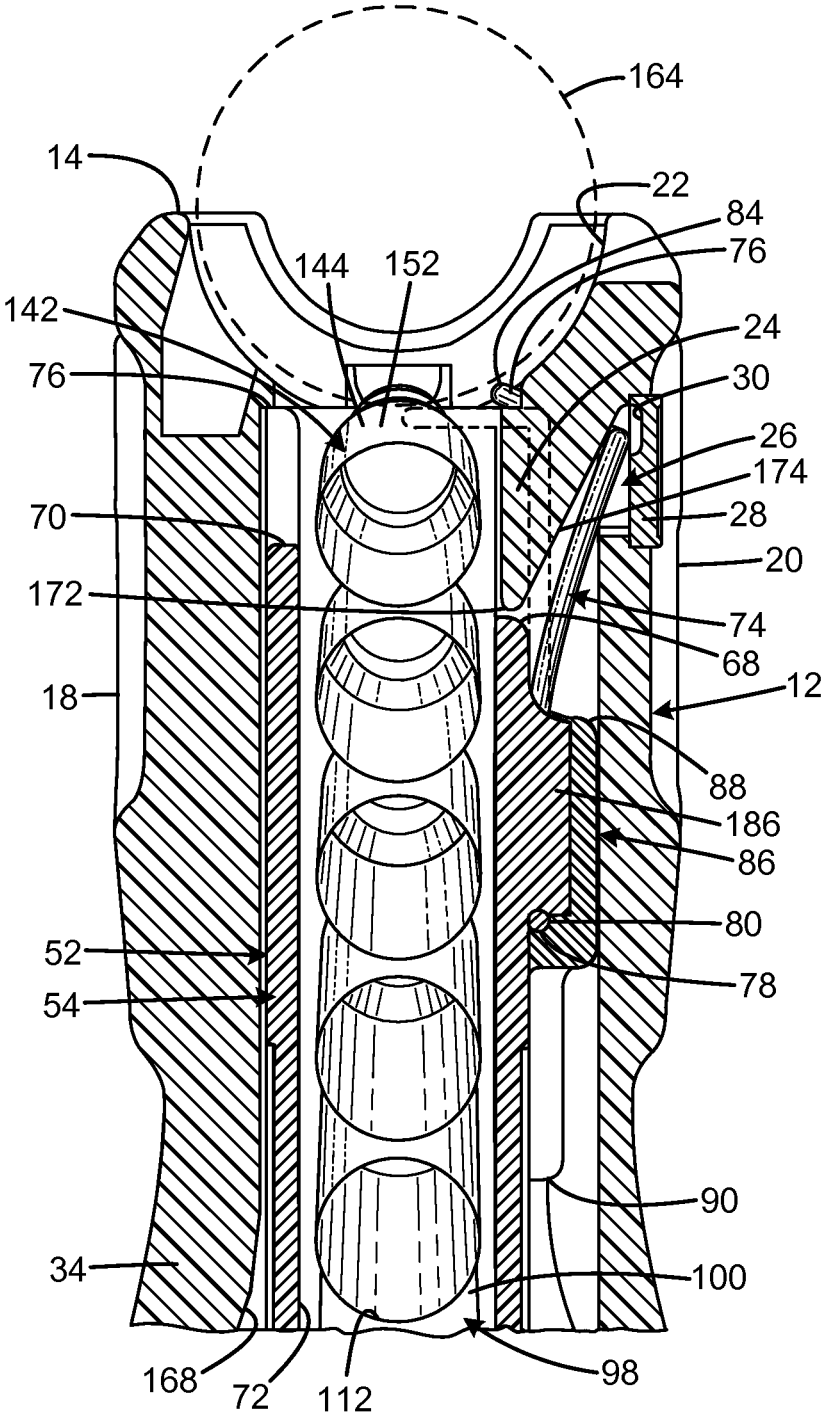
FIG. 5 is a rear sectional view of the current embodiment of the magazine of FIG. 2 loaded with five cartridges.

FIG. 5 illustrates the improved magazine 52 fully inserted into the central bore 168 of the magazine well 34. Five cartridges 142 are received within the central bore 72 of the magazine body 54 of the magazine 52. The sloped surface 174 of the ramp (or actuation element) 24 contacts a portion of the top 76 of the cartridge catch 74 behind the U-bend portion 84. This contact flexes the U-bend portion 84 of the cartridge catch outwardly into the recess 26 in the right side 20 of the body 12. The recess 30 on the cover plate allows the cartridge catch 74 to move further into the recess 26 in the right side of the body. As a result, the U-bend portion of the cartridge catch no longer contacts the uppermost cartridge 142, making the cartridge free to feed upward to charge the receiver 164. In the current embodiment, the magazine body has a capacity of five cartridges 142. However, the magazine body can be lengthened in an alternative embodiment to have a capacity of up to ten cartridges.

Figure 6:
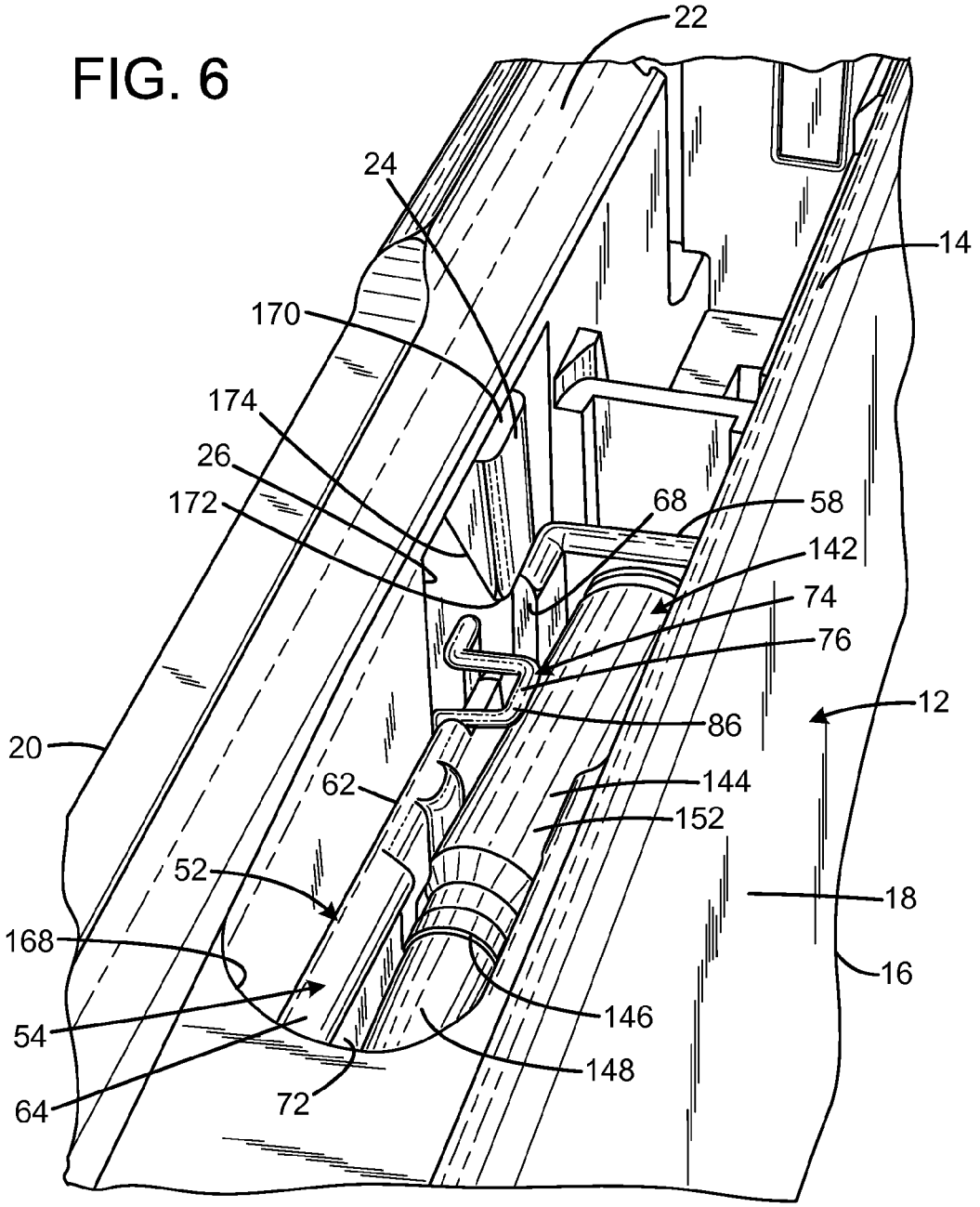
FIG. 6 is a top front isometric fragmentary view of the current embodiment of the magazine of FIG. 2 showing initiation of the installation process in the rifle stock of FIG. 1.
Figure 7:
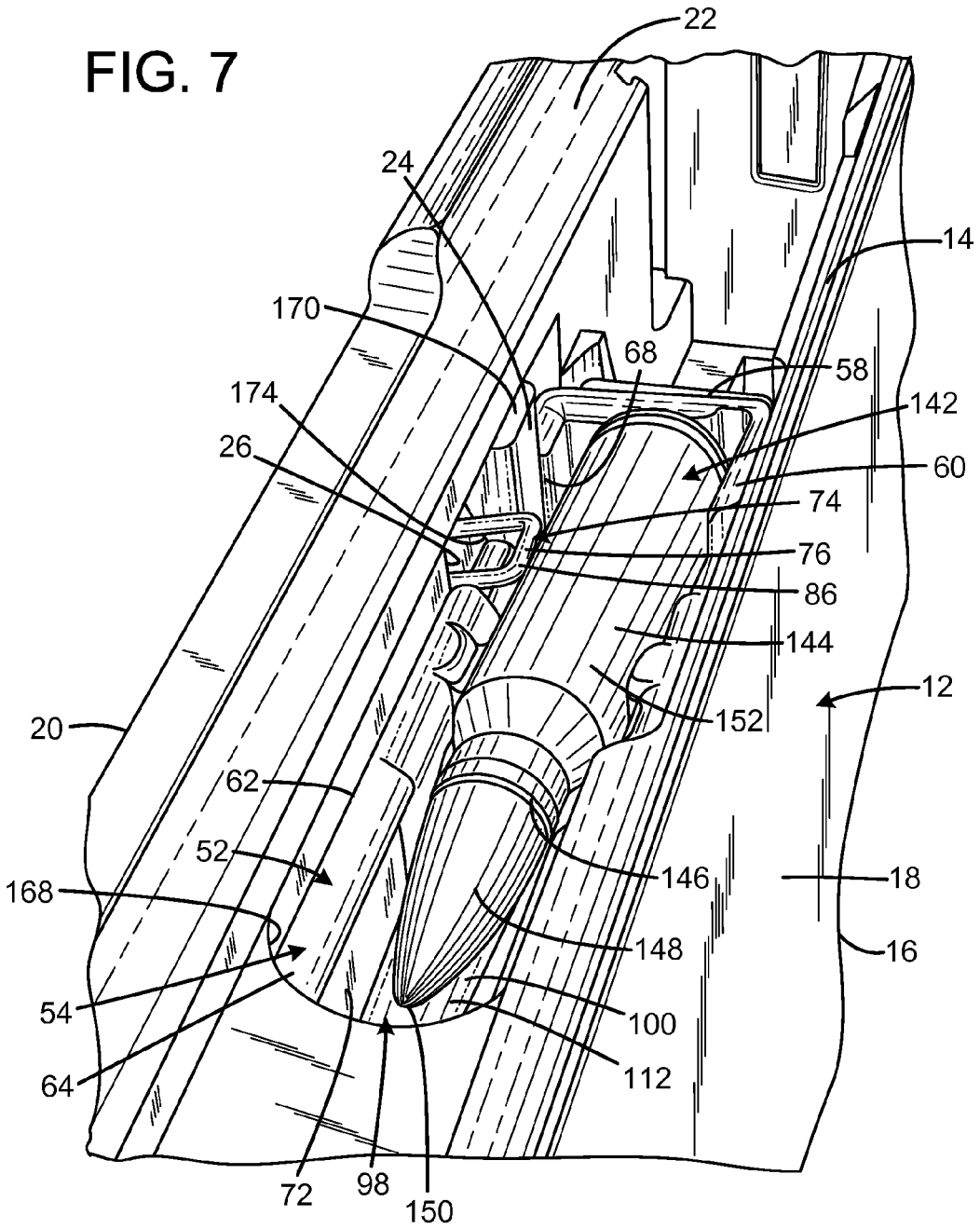
FIG. 7 is a top front isometric fragmentary view of the current embodiment of the magazine of FIG. 2 showing the next step in the installation process in the rifle stock of FIG. 1.
Figure 8:
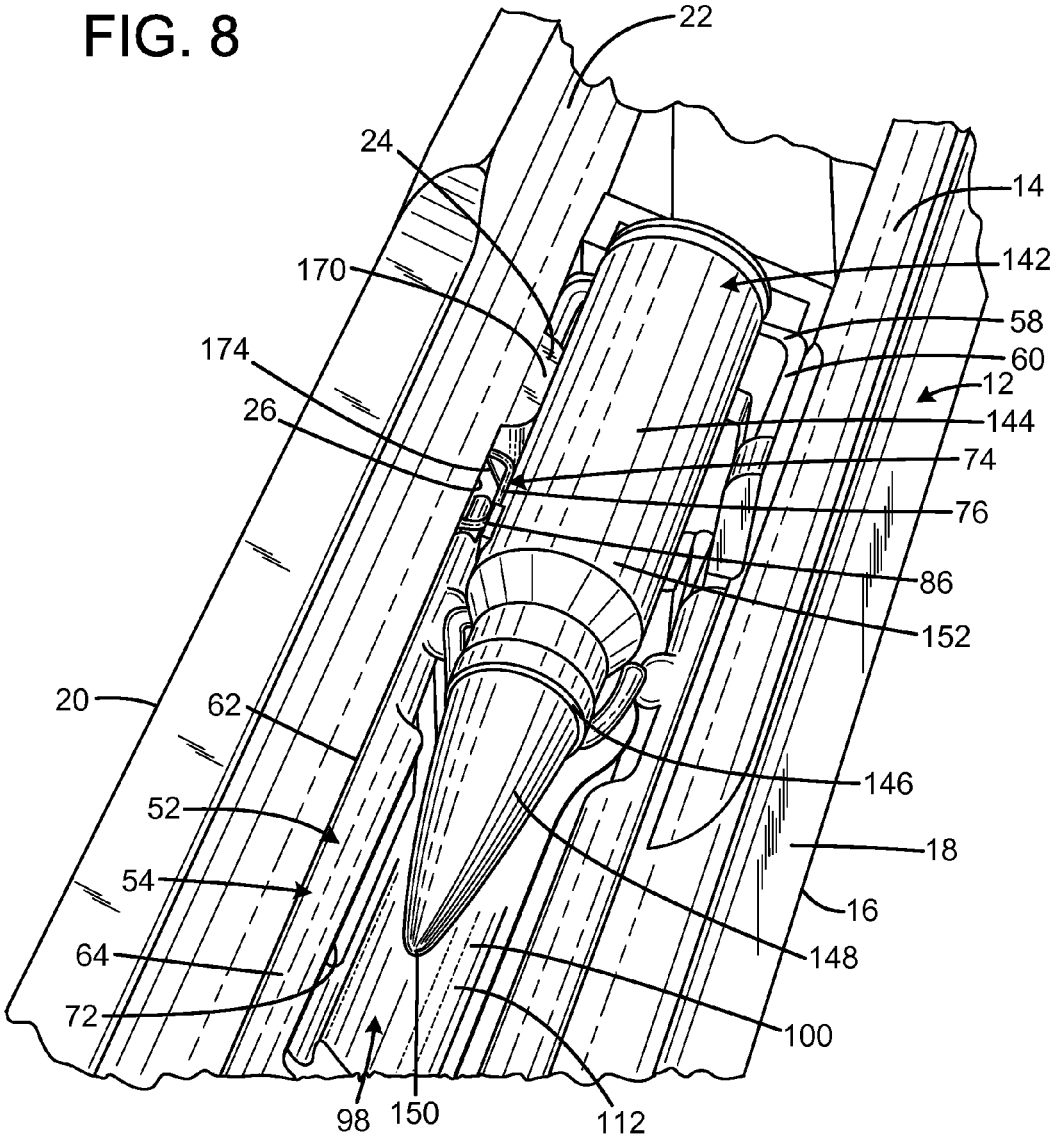
FIG. 8 is a top front isometric fragmentary view of the current embodiment of the magazine of FIG. 2 showing the final step in the installation process in the rifle stock of FIG. 1.

FIGS. 6-8 illustrate the improved magazine 52 within the central bore 168 of the magazine well 34 of the rifle stock 10 of the present invention. More particularly, the figures depict the sequence of operations that occur as the magazine is inserted into the magazine well that make the uppermost cartridge 142 available to charge into the receiver 164. In FIG. 6, the magazine is shown partially inserted into the magazine well. The ramp 24 has a downwardly protruding bottom tip 172 and an upwardly flat sloped actuation surface portion 174 to form a tapered wedge-shaped actuation element that is narrowest at its lowest end. The actuation surface portion is acutely angled with respect to the insertion axis, such that insertion of a magazine by a selected amount generates lateral motion of the cartridge catch 74 by a lesser amount to provide a mechanical advantage. The actuation surface portion faces generally laterally away from the magazine well, such that the actuation surface portion operates to move the cartridge catch away from the centerline of the magazine. The magazine body 54 is shaped to fit within the central bore 168 of the magazine well so that the U-bend portion 84 of the cartridge catch is laterally aligned with the recess 26 in the right side 20 of the body 12. The portion of the top 76 of the cartridge catch immediately behind the U-bend portion is positioned to contact the sloped surface of the ramp immediately adjacent to the bottom tip.

FIG. 7 shows the magazine 52 inserted further into the central bore 168 of the magazine well 34, but not yet fully inserted. The portion of the top 76 of the cartridge catch 74 immediately behind the U-bend portion has contacted the sloped surface 174 of the ramp 24. The sloped surface causes the cartridge catch to flex outwardly toward the right side 20 of the body 12. A portion of the U-bend portion 84 of the cartridge catch has entered the recess 26 in the right side of the body. The lateral movement of the cartridge catch permits the follower 98 to urge the cartridge 142 upwards partially above the top 64 of the magazine body 54 before contact between the U-bend portion of the cartridge catch and the exterior surface 152 of the casing 144 limits the upward movement.

FIG. 8 shows the magazine 52 fully inserted into the central bore 168 of the magazine well 34. Continued insertion of the magazine enables the sloped surface to push the cartridge catch 74 to flex outwardly even further toward the right side 20 of the body 12. Substantially all of the U-bend 84 portion of the cartridge catch has entered the recess 26 in the right side of the body. The lateral movement of the cartridge catch permits the follower 98 to further urge the cartridge 142 upwards, and the cartridge catch no longer limits the upward movement of the cartridge. Therefore, the cartridge is free to feed upward, except that by the time the magazine is fully inserted, upward movement of the cartridge is constrained by the receiver 164, and the cartridge is held in a position where the cartridge is ready for feeding.

Figure 9:
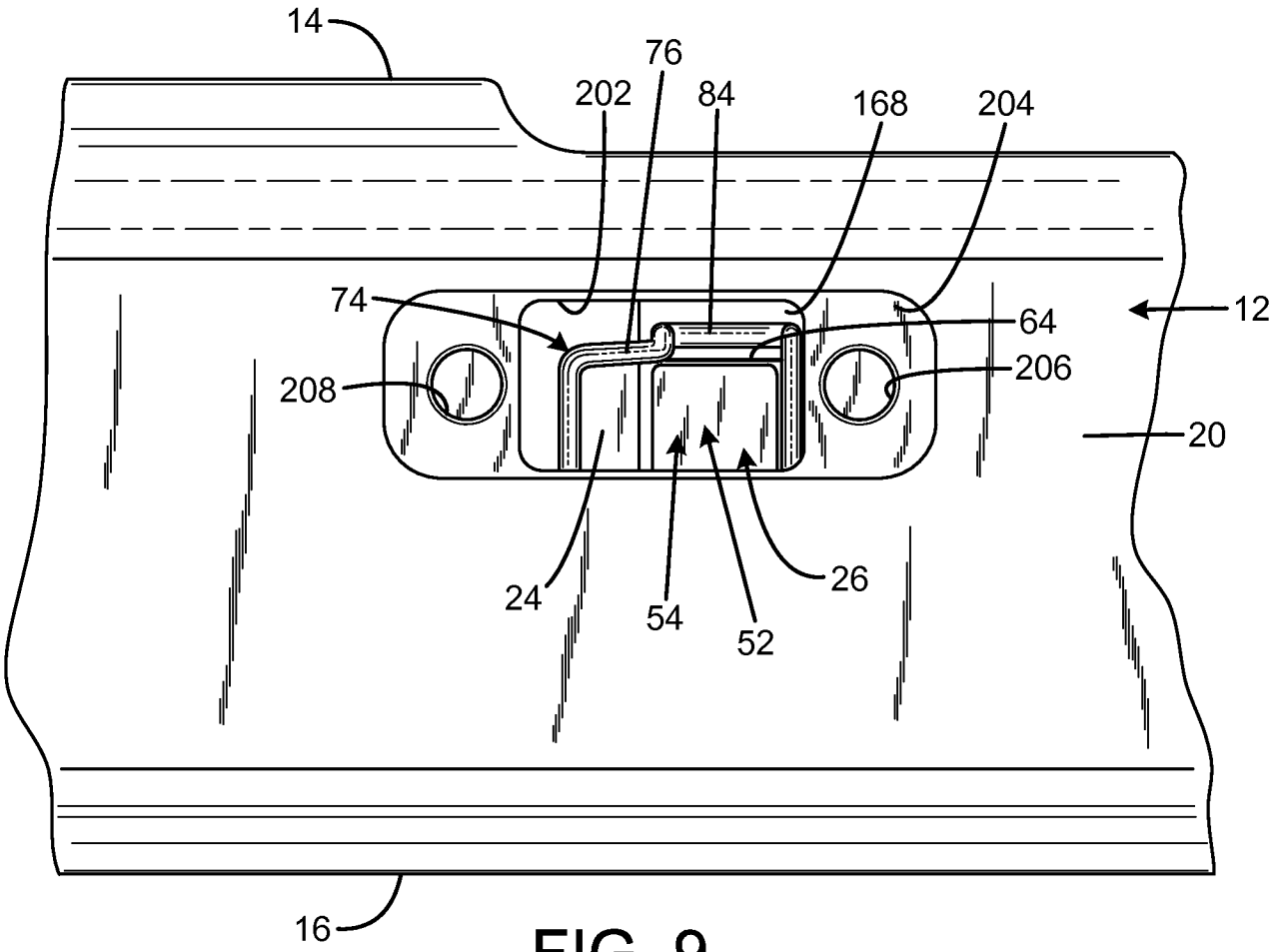
FIG. 9 is a right side fragmentary view of the current embodiment of the magazine of FIG. 2 installed in the rifle stock of FIG. 1.

FIG. 9 illustrates the improved rifle stock 10 of the present invention. More particularly, the right side 20 of the body 12 is shown with the magazine 52 fully inserted into the central bore 168 of the magazine well 34. The right side of the body defines an access aperture 202 and a recess 204. The aperture communicates with the central bore of the magazine well. Two threaded cover plate screw holes 206, 208 are defined within the recess on either side of the aperture 184. The recess is sized to receive the cover plate 28, which is removably secured to the body by screwing the cover plate screws 32 into the cover plate screw holes.

FIGS. 10 & 11 illustrate the improved rifle stock 10 of the present invention. More particularly, the dashed lines on the ramp 24 denote the mold part line 176. In the current embodiment, to make a practical and cost effective stock 10 that is molded with two primary tool halves and one moving core for the central bore 168 of the magazine well 34, the body has an aperture 202 in the right side of the stock at the magazine well so the angled "active" sloped surface 174 of the wedge-shaped ramp 24 faces outwardly and can be formed by one primary half of the mold tool. The cover plate 28 covers the aperture to prevent dirt and debris from entering the body 12 through the aperture and to provide the finished product with a clean appearance.

While a current embodiment of a rifle stock has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, the ramp can be a separate piece that is screwed into the right side of the body from below, instead of the integrally molded piece described, which would eliminate the need for the aperture, cover plate, and associated features. Furthermore, the cartridge catch retainer, front, rear, and central supports, and their associated features could be eliminated by insert molding the cartridge catch in place.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rifle stock for receiving a magazine having a movable cartridge retention element, the rifle stock comprising: a body defining a magazine well; a magazine for containing ammunition cartridges, the magazine having a magazine body with an exterior profile sized to have at least a portion closely and removably received in the magazine well; the magazine body defining a central passage configured to receive a plurality of ammunition cartridges; the central passage having an open upper end; a movable cartridge retention element attached to the magazine body and movable between a first retention position, and a second released position; the movable cartridge retention element having a retention portion that is positioned above at least a portion of the open upper end of the central passage when the cartridge retention element is in the first retention position, and positioned laterally clear of the open upper end of the central passage when the cartridge retention element is in the second released position, such that cartridges in the magazine passage are prevented from escaping when the cartridge retention element is in the first position, and permitted to escape when the cartridge retention element is in the second position; the body including an actuation element proximate the magazine well; the magazine well being a passage defining an insertion axis; the actuation element having an inner surface facing a selected portion of the magazine well and an opposed outer surface facing away from the selected portion of the magazine well, the outer surface having an actuation surface portion angularly offset from the insertion axis, such that the cartridge retention element operably encounters and is moved by the actuation surface upon insertion of the magazine; the body defining a receiver receptacle channel adapted to closely receive a portion of a rifle receiver; and the actuation element being at a level below the receiver receptacle channel.

2. The rifle stock of claim 1 wherein the cartridge retention element is biased to the first position.

3. The rifle stock of claim 1 wherein the cartridge retention element is retained in the second position when the magazine is fully inserted into the magazine well.

4. The rifle stock of claim 1 wherein the cartridge retention element is the only portion of the magazine overhanging the open end of the passage.

5. The rifle stock of claim 1 wherein the cartridge retention element is a resilient cantilever.

6. The rifle stock of claim 1 wherein the cartridge retention element is a metal wire.

7. The rifle stock of claim 1 wherein the cartridge retention element is an elongated articulated element having element ends attached to the magazine body, and an intermediate portion including the retention portion.

8. The rifle stock of claim 1 wherein the cartridge retention element is a U-shaped member.

9. The rifle stock of claim 1 wherein the stock defines an access aperture providing communication with the magazine well.

10. The rifle stock of claim 9, wherein the access aperture is proximate the actuation surface portion.

11. The rifle stock of claim 9, including a cover enclosing the access aperture.

12. The rifle stock of claim 1 wherein the actuation surface portion is acutely angled with respect to the insertion axis, such that insertion of the magazine by a selected amount generates lateral motion of the cartridge retention element by a lesser amount to provide a mechanical advantage.

13. The rifle stock of claim 1 wherein the actuation surface portion is a flat slope.

14. The rifle stock of claim 1 wherein the stock body defines a recess that receives the movable cartridge retention element when the actuation element urges the movable cartridge retention element away from a central bore of the magazine.

15. The rifle stock of claim 1 wherein a cartridge received within the central passage of the magazine body feeds vertically upwards from the magazine body when the magazine is fully inserted into the magazine well.

16. A rifle stock for receiving a magazine having a movable cartridge retention element, the rifle stock comprising: a body defining a magazine well; a magazine for containing ammunition cartridges, the magazine having a magazine body with an exterior profile sized to have at least a portion closely and removably received in the magazine well; the magazine body defining a central passage configured to receive a plurality of ammunition cartridges; the central passage having an open upper end; a movable cartridge retention element attached to the magazine body and movable between a first retention position, and a second released position; the movable cartridge retention element having a retention portion that is positioned above at least a portion of the open upper end of the central passage when the cartridge retention element is in the first retention position, and positioned laterally clear of the open upper end of the central passage when the cartridge retention element is in the second released position, such that cartridges in the magazine passage are prevented from escaping when the cartridge retention element is in the first position, and permitted to escape when the cartridge retention element is in the second position; the body including an actuation element proximate the magazine well; the magazine well being a passage defining an insertion axis; the actuation element having an inner surface facing a selected portion of the magazine well and an opposed outer surface facing away from the selected portion of the magazine well, the outer surface having an actuation surface portion angularly offset from the insertion axis, such that the cartridge retention element operably encounters and is moved by the actuation surface upon insertion of the magazine; the body defining a receiver receptacle channel adapted to closely receive a portion of a rifle receiver; the actuation element being at a level below the receiver receptacle channel; and wherein the actuation surface faces laterally away from the midline of the stock.

17. A rifle stock for receiving a magazine having a movable cartridge retention element, the rifle stock comprising: a body defining a magazine well; a magazine for containing ammunition cartridges, the magazine having a magazine body with an exterior profile sized to have at least a portion closely and removably received in the magazine well; the magazine body defining a central passage configured to receive a plurality of ammunition cartridges; the central passage having an open upper end; a movable cartridge retention element attached to the magazine body and movable between a first retention position, and a second released position; the movable cartridge retention element having a retention portion that is positioned above at least a portion of the open upper end of the central passage when the cartridge retention element is in the first retention position, and positioned laterally clear of the open upper end of the central passage when the cartridge retention element is in the second released position, such that cartridges in the magazine passage are prevented from escaping when the cartridge retention element is in the first position, and permitted to escape when the cartridge retention element is in the second position; the body including an actuation element proximate the magazine well; the magazine well being a passage defining an insertion axis; the actuation element having an inner surface facing a selected portion of the magazine well and an opposed outer surface facing away from the selected portion of the magazine well, the outer surface having an actuation surface portion angularly offset from the insertion axis, such that the cartridge retention element operably encounters and is moved by the actuation surface upon insertion of the magazine; the body defining a receiver receptacle channel adapted to closely receive a portion of a rifle receiver; the actuation element being at a level below the receiver receptacle channel; and wherein the actuation element is a tapered wedge narrowest at a lowest end.

18. The rifle stock of claim 1 including a magazine received in the magazine well, the magazine having a movable cartridge retention element biased against the actuation surface.

* * * * *